US007793921B2

(12) United States Patent
Ganghofer et al.

(10) Patent No.: US 7,793,921 B2
(45) Date of Patent: Sep. 14, 2010

(54) MOTION-RESTRAINT ARRANGEMENT

(75) Inventors: Andreas Ganghofer, Röthenbach (DE); Peter Kreuzer, Igensdorf (DE); Roland Müller, Büchenbach (DE)

(73) Assignee: Diehl BGT Defence GmbH & Co. KG., Überlingen (DE)

( * ) Notice: Subject to any disclaimer, the term of this patent is extended or adjusted under 35 U.S.C. 154(b) by 749 days.

(21) Appl. No.: 11/709,418

(22) Filed: Feb. 22, 2007

(65) Prior Publication Data

US 2007/0235269 A1 Oct. 11, 2007

(30) Foreign Application Priority Data

Mar. 22, 2006 (DE) ..... 10 2006 013 007

(51) Int. Cl.
*E04H 17/02* (2006.01)

(52) U.S. Cl. ..... 256/33; 256/39

(58) Field of Classification Search ..... 256/2, 256/3, 32–58

See application file for complete search history.

(56) References Cited

U.S. PATENT DOCUMENTS 2,801,080 A 7/1957 See
6,470,784 B1 10/2002 Bonavita et al.

FOREIGN PATENT DOCUMENTS

| | | | |
|---|---|---|---|
| BE | 425339 | A | 12/1937 |
| DE | 103 48 055 | A1 | 10/2003 |
| DE | 103 48 055 | A1 | 5/2005 |
| FR | 1187307 | A | 11/1957 |
| FR | 1269646 | A | 5/1960 |
| WO | 03/044307 | A1 | 5/2003 |

*Primary Examiner*—Victor MacArthur
(74) *Attorney, Agent, or Firm*—Scully, Scott, Murphy & Presser, P.C.

(57) ABSTRACT

A motion-restraint arrangement (48) with elongate lines of elements (10), wherein each line of elements (10) has a number of individual elements (12) which can be erected by spring elements (20) from a small-volume thin storage condition into a large-volume active condition. Each respective individual element (12) has flexible lateral edge elements (16, 18), which in the active condition define a parallelepiped. The spring elements (20) extend in spatially diagonal relationship between the corners (22) of the respective parallelepiped (14). A motion-restraint arrangement (48) which is easy and inexpensive to produce and which has optimum restraint properties is obtained in that the spatially diagonal spring elements (20) are formed by spring wires (24), which extend in a zigzag shape in the longitudinal direction of the respective line of elements (10).

15 Claims, 3 Drawing Sheets

MOTION-RESTRAINT ARRANGEMENT

BACKGROUND OF THE INVENTION

1. Field of the Invention

The invention pertains to a motion-restraint arrangement, including a number of individual elements, which can be erected by spring elements from a thinly compressed, small-volume storage condition into a large-volume active condition.

2. Discussion of the Prior Art

A motion-restraint arrangement of that kind is known from the disclosure of German Publication No. DE 103 48 055 A1. In that known motion-restraint arrangement a number of individual elements which in the active condition form a respective parallelepiped can be combined to form an elongate line of elements. It is likewise possible for a number of elongate lines of elements to be arranged in mutually superposed and/or mutually juxtaposed relationship to afford a large rampart-like or wall-like obstacle. At any event however that involves the use of a number of individual elements with spatially diagonal spring elements and flexible lateral edge elements, that is to say corresponding individual elements consisting of the spatially diagonal spring elements and the flexible lateral edge elements are produced and then assembled, that is to say connected together, to afford at least one elongate line of elements. That represents a manufacturing complication and expenditure, which is not to be disregarded.

SUMMARY OF THE INVENTION

The object of the invention is to develop the motion-restraint arrangement of the kind set forth in the opening part of this specification, in such a way that manufacture thereof is simplified and is thus possible at lower cost and at the same time the restraint properties are further improved in its active condition.

According to the invention that object is attained in that the spring elements are spatially diagonally arranged, and are formed by spring wires which extend in a zigzag shape in a longitudinal direction of an elongate line of elements formed by the individual elements. Preferred configurations and developments of the motion-restraint arrangement according to the invention are set forth in the further claims.

In the case of the motion-restraint arrangement according to the invention the flexible lateral edge elements of the or each elongate line of elements are formed by microwires, fibres or fibre bundles, referred to as rovings. The microwires, fibres, or fibre bundles can comprise metals, metal alloys, glass materials, ceramics, polymer materials, carbon fibres or the like. The spring elements are preferably formed from spring steel wires, which extend along the elongate line of elements.

The respective line of elements of the motion-restraint arrangement according to the invention is of such a configuration that the spatially diagonal spring elements extend in a zigzag configuration in the longitudinal direction of the line of elements. In that case the respective zigzag-shaped spring wire can be in one piece, that is to say integral in respect of the material involved, or it can comprise individual, spatially diagonal spring wires, which are connected together by connecting elements in the corners of the respective spring element.

The four continuous zigzag-shaped spring elements can be suitably pushed into each other in order to produce the four spatial diagonals of all successive individual elements of the respective line of elements, in a timesaving fashion. That advantageously signifies production optimisation which entails the advantage that, in the compressed, that is to say small-volume, thinly compressed storage condition, resilient torsional or bending forces are produced and stored, which—after suitable triggering—erect the compressed individual elements and thus the elongate line of elements from the small-volume thin storage condition into the active condition. That erection movement takes place in the longitudinal direction of the line of elements.

The flexible lateral edge elements are fixed to the corners of the zigzag-shaped spring wires. That fixing can be effected for example using a sewing procedure with self-securing stitches or by a self-securing looping procedure. For that purpose, for example eyes can be provided at the corners of the zigzag-shaped spring wires for fixing the flexible lateral edge elements. The spring wires can form the eyes by suitable bending thereof themselves. The eyes can be disposed in the respective corner plane of the associated zigzag-shaped spring wire. It is likewise possible for the eyes to be oriented in the longitudinal direction of the respective line of elements or in the transverse direction thereof.

Another possibility for example provides that plate elements are fixedly crimped or fixedly welded to the corners of the zigzag-shaped spring wires in order to fix the flexible lateral edge elements thereto.

It is preferable if the fixing of the flexible lateral edge elements to the corners of the zigzag-shaped spring wires is subsequently secured. For that purpose, that is to say to secure the fixing, it is possible to use adhesive, resins, arresting clips or for example ultrasonic welding with a feed of plastic materials with a low melting point. When using the above-mentioned plate elements it is also possible for example to crimp the loops of the flexible lateral edge elements to a plate element tongue.

In the motion-restraint arrangement according to the invention the flexible transverse edge elements and the flexible longitudinal edge elements of the individual elements forming a parallelepiped in the active condition can be of equal length. Likewise it is possible for the longitudinal edge elements of each second, third or n-th individual element to be longer than the transverse edge elements of the individual elements in order further to optimise the restraint effect of the motion-restraint arrangement according to the invention because the consequence of such a configuration of the last-mentioned kind is that the respective elongate line of elements retains its shape in the erected active state but a corresponding number of the flexible longitudinal edge elements sag down slackly in the active condition of the motion-restraint arrangement and thus positively increase the restraint effect or the properties in terms of providing a trip obstacle.

The flexible longitudinal edge elements can extend integrally in the longitudinal direction and the flexible transverse edge elements can extend integrally in the peripheral direction of the respective line of elements.

In order further to increase the restraint effect it is also possible for restraint elements to be provided at least at some corners of the zigzag-shaped spring wires. Those restraint elements can be for example in the form of bars, barbs, points, sharp-edged metal or plastic plate portions or the like. By means of such restraint elements the motion-restraint arrangement according to the invention can better spread for example on floors of buildings or the like and in addition the motion-restraint arrangement according to the invention which is of such a configuration can also better hook on the footwear and/or clothing of an intruder.

It has proven to be advantageous if a number of lines of elements, in their small-volume, thinly compressed storage condition, are provided in a packing, which can have a release device for the lines of elements. That release device can have a time delay member, a remote control and/or a sensor arrangement. The sensor arrangement is for example a sensor arrangement, which reacts to vibration or approach movement. The remote control can involve for example a ripcord or the like.

The packing can have a number of mutually independent layers each with a respective number of thinly compressed lines of elements. By way of example, disposed in the packing is a plurality of lines of elements, which are contained in the packing in a condition of being thinly compressed to the densest possible space. After the packing is opened the zigzag-shaped spring wires are relieved and the lines of elements spring out of the packing and are distributed in the room so-to-speak in an unordered fashion in a tangled three-dimensional pattern in order to form the motion-restraint arrangement. In that respect the packing can be opened for example when lying on a floor or in an in-flight situation. To provide that the lines of elements spring out of the opened packing in a more or less directed fashion the packing can have a number of mutually separated layers. Each of those layers can have a number of thinly compressed lines of elements. The layers can be released in succession in respect of time. Each layer can have a strip plate so that the associated strip plate deflects the lines of elements of the respective layer, on springing out of the packing. Accordingly it is possible to cover all directions in space, that is to say ejection directions for the lines of elements, by suitably arranging, that is to say positioning, the strip plates.

In the case of the motion-restraint arrangement according to the invention the elongate lines of elements can be provided separately independently of each other. Likewise it is possible for at least some of the lines of elements to be connected together by flexible connecting elements. Such a configuration of the last-mentioned kind is advantageous in a situation involving distribution of the lines of elements over a large area or large volume.

The restraint action of the motion-restraint arrangement according to the invention can also be still further enhanced by the packing being combined with at least one action or effect agent, that is to say if the motion-restraint arrangement is used in an effect agent assembly. The effect agent can be for example a smoke generator, an electrical shock device or the like. Likewise it is possible for the motion-restraint arrangement to be used in combination with adhesive or in combination with irritants such as CS gas, pepper spray or the like.

With the motion-restraint arrangement according to the invention it is possible for example to close off an area of terrain to be secured, pipes, passageways and so forth, wherein the block can be crossed by one's own action forces without danger until it is activated. The motion-restraint arrangement according to the invention can serve for latently securing high-value objects. For that purpose the motion-restraint arrangement can be provided for example in a small volume in small ejection containers, which for example are positioned at the accesses to the objects and are triggered when required. With the motion-restraint arrangement according to the invention it is possible for example to prevent burglaries and break-ins if the motion-restraint arrangement is used for example in the effect agent assembly with mist generators or the like. Further possible uses of the motion-restraint arrangement according to the invention are for example preventing fugitives from escaping by remote implementation of the motion-restraint arrangement, until they are captured. For that purpose the motion-restraint arrangement can be launched with a suitable projector. The motion-restraint arrangement according to the invention can for example also be carried on a man. A further advantage lies in clearance without any problem by the use of special clearance devices, or that, in a situation involving targeted launch into electrical installations, short-circuits thereof can be triggered off.

BRIEF DESCRIPTION OF THE DRAWINGS

Further details, features and advantages will be apparent from the description hereinafter of embodiments diagrammatically illustrated in the drawing by way of example of the motion-restraint arrangement according to the invention and detail aspects thereof, in which respect it will be appreciated that the invention is not restricted to the illustrated configurations but is defined by the claims, wherein:

DETAILED DESCRIPTION OF THE INVENTION

Figure 1:
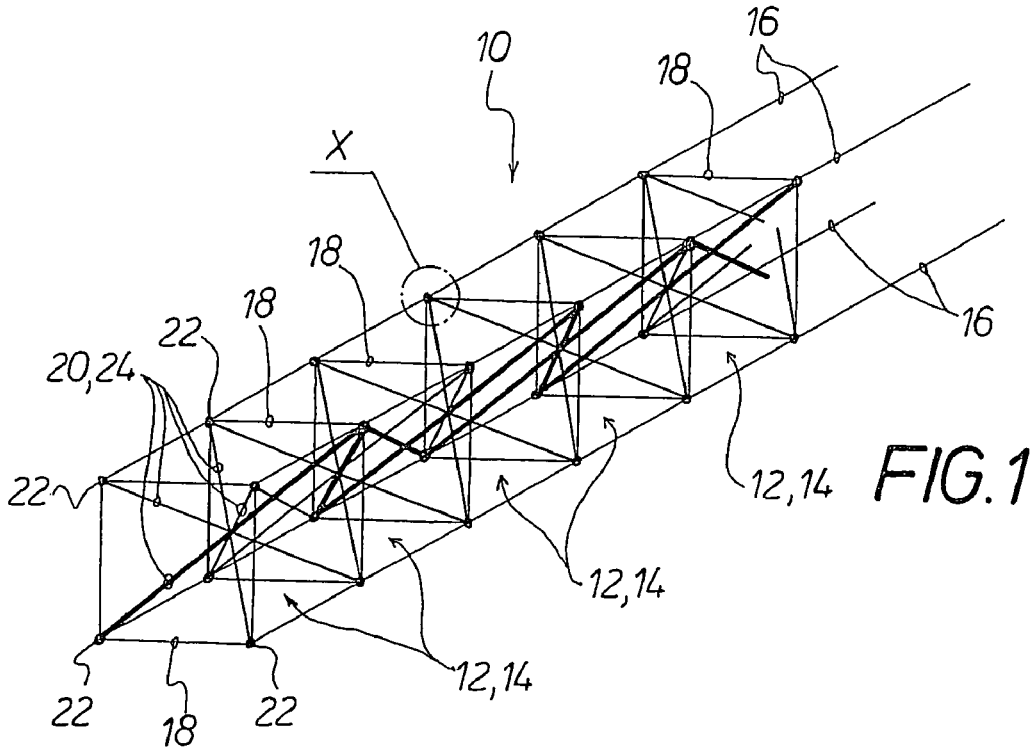
FIG. 1 shows a perspective view of a portion of a line of elements.

FIG. 1 shows an elongate line of elements 10 of a motion-restraint arrangement 48. The line of elements 10 has a number of individual elements 12, which, in the active condition shown in FIG. 1, each form a respective parallelepiped 14. The respective parallelepiped 14 is defined by flexible longitudinal edge elements 16 and by flexible transverse edge elements 18. The longitudinal and transverse edge elements 16 and 18 thus form the lateral edge elements of the respective individual element 12. The longitudinal edge elements 16 extend in one piece in the longitudinal direction of the line of elements 10 and the transverse edge elements 18 extend in the peripheral direction of the line of elements 10.

The individual elements 12 have four spring elements 20 which extend in spatially diagonal relationships between the corners 22 of each parallelepipedic individual element 12.

In accordance with the invention the spatially diagonal spring elements 20 are formed by spring wires 22 which extend in a zigzag shape in the longitudinal direction of the line of elements 10. One of those four spatially diagonal spring elements 20 extending in a zigzag shape in the longitudinal direction of the line of elements 10 is indicated by a thicker solid line while the other three spatially diagonal spring elements 20 are shown in thinner lines.

Figure 3:
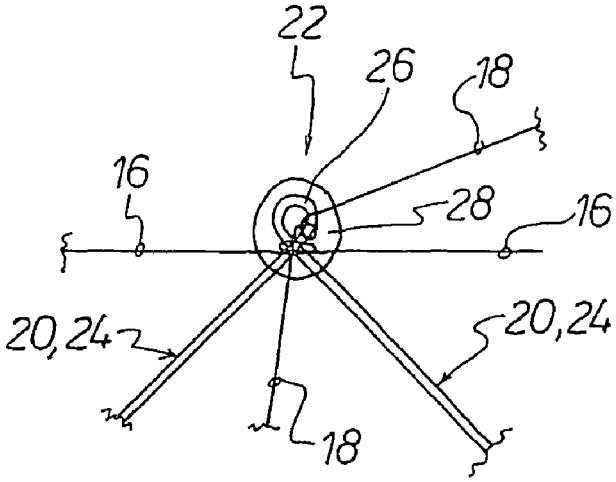
FIG. 3 shows a configuration of the detail X in FIG. 1.
Figure 4:
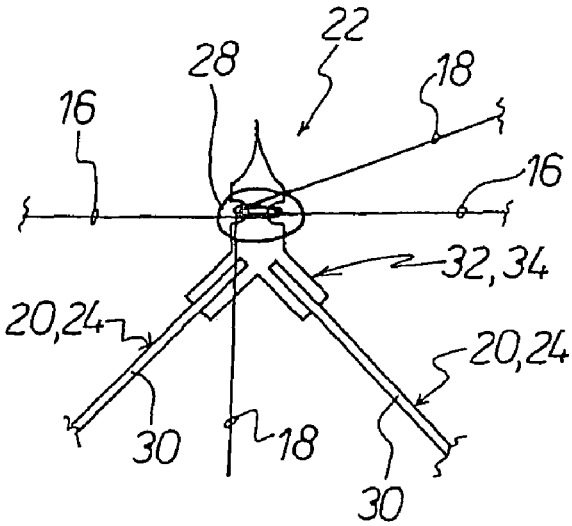
FIG. 4 shows a further configuration of the detail X in FIG. 1.
Figure 5:
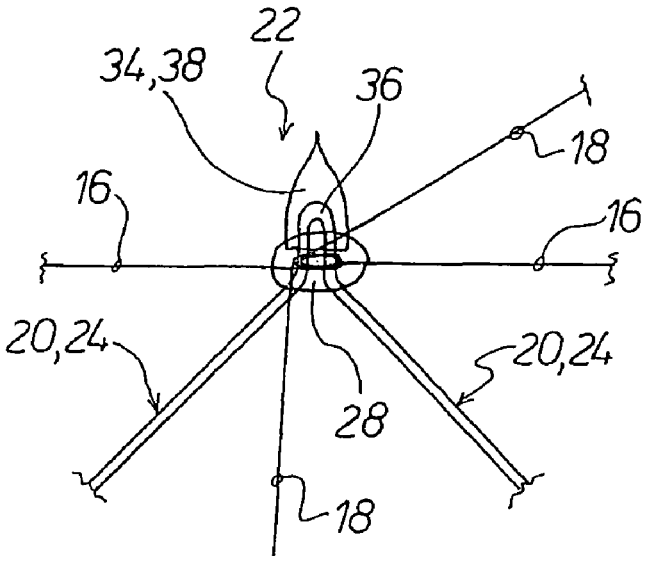
FIG. 5 shows yet another configuration of the detail X in FIG. 1.

The flexible longitudinal edge elements 16 and the flexible transverse edge elements 18 are fixed to the corners 22 of the zigzag-shaped spring wires 24. That fixing of the lateral edge elements 16 and 18 to the corners 22 can be effected for example using a per se known sewing or loop procedure. Such a loop procedure is shown in FIGS. 3, 4 and 5. In that respect FIG. 3 shows a corner 22 of a spring wire 24, which is provided in each corner 22 with an eye 26. The respective eye 26 serves for fixing both the associated flexible longitudinal edge element 16 and also the associated transverse edge element 18. Fixing of the edge elements 16 and 18 at the respective eye 26 can be subsequently secured. That securing 28 can be effected by means of an adhesive or by means of a resin. The securing 28 can for example also be implemented by feeding a plastic material with a low melting point by ultrasonic welding. It will be appreciated that other ways of producing the securing 28 for the fixing of the edge elements 16 and 18 at the corners 22 of the spring elements 20 are also possible.

While FIG. 3 shows a configuration in which the respective zigzag-shaped spring wire 24 extends integrally in respect of its material along the line of elements 10 FIG. 4 shows an embodiment in which the respective zigzag-shaped spring wire 24 comprises individual spatially diagonal spring wires 30 which are connected at the corners 22 by connecting elements 32. Welding can make that connection or gluing the spatially diagonal spring wires 30 to the connecting elements 32. The connecting elements 32 can be formed at the same time as restraint elements with cutting edges, points, teeth or the like and serve for fixing the longitudinal and transverse edge elements 16 and 18. That fixing can be effected in a self-securing manner using a loop or sewing procedure. The fixing can be further optimised by a securing means 28 as has been referred to hereinbefore for example with reference to FIG. 3.

FIG. 5 diagrammatically shows a corner 22 of a zigzag-shaped spring wire 24, which is provided with an outward bulge portion 36 on which a push-on portion 38 is provided. The push-on portion 38 can be in the form of a restraint element 34 with a point, an edge, a cutting edge or the like and can serve at the same time for fixing the longitudinal and transverse edge elements 16 and 18 for example using a looping or sewing procedure. The fixing of the edge elements 16 and 18 at the respective corner 22 can be further improved by a securing means 28 as has been referred to hereinbefore with reference to FIGS. 3 and 4.

Figure 6:
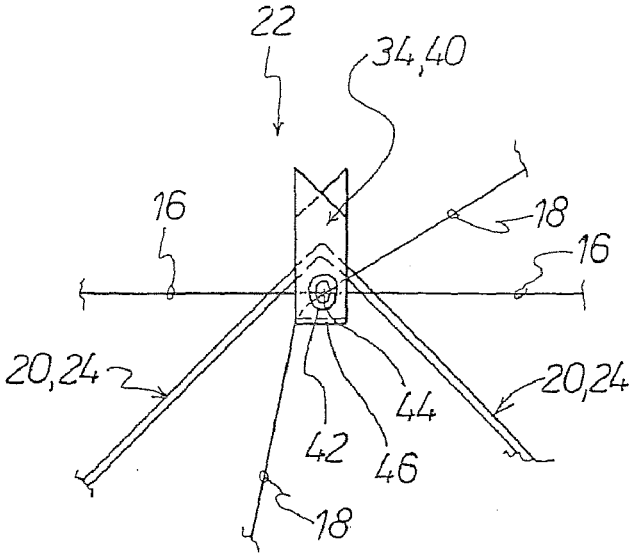
FIG. 6 shows a further configuration of the detail X in FIG. 1, in which respect it is evident that still other configurations of the detail X as shown in FIG. 1 are also realizable pursuant to the invention.

FIG. 6 diagrammatically shows a corner 22 of a zigzag-shaped spring wire 24 to which there is fixed a two-limb surface element 40, which forms a restraint element 34. The one limb of the surface element 40 is provided with a hole 42 and the second limb is provided with a knob 44 which projects into the hole 42 when the two limbs of the element 40 are bent towards each other around the common shoulder 46 and bear against each other and clamp fast and fix between them the associated spring wire 24 and the flexible edge elements 16 and 18. The two limbs of the surface element 40 are then appropriately welded or glued together.

As has already been stated above, FIGS. 3 to 6 only show some possible forms of implementation of the fixed connection between the zigzag-shaped spring elements 20 and the flexible edge elements 16 and 18 of the respective line of elements 10, in which respect it will be appreciated that other possible embodiments are also conceivable.

Figure 2:
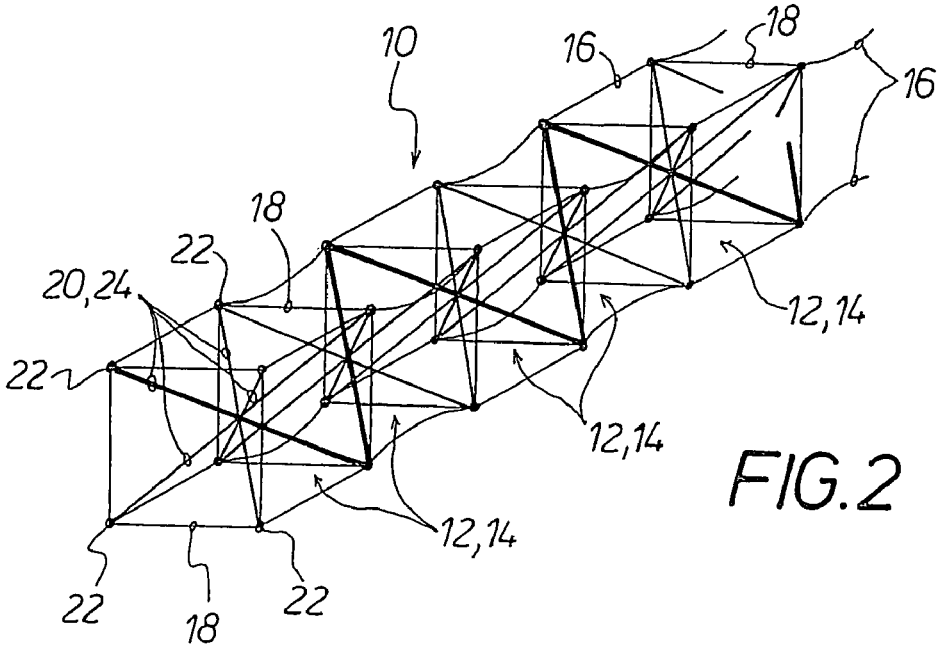
FIG. 2 shows a view similar to FIG. 1 of another embodiment of a line of elements, of which a portion is shown.

FIG. 1 shows a configuration of an elongate line of elements 10, in which the flexible longitudinal edge elements 16 and the flexible transverse edge elements 18 of each individual element 12 are of the same length. In comparison, FIG. 2 shows a perspective view similar to FIG. 1 illustrating a configuration of a line of elements 10, in which the longitudinal edge elements 16' of each second individual element 12 are longer than the longitudinal edge elements 16 of the other individual elements 12 or the transverse edge elements 18 of the individual elements 12.

Figure 7:
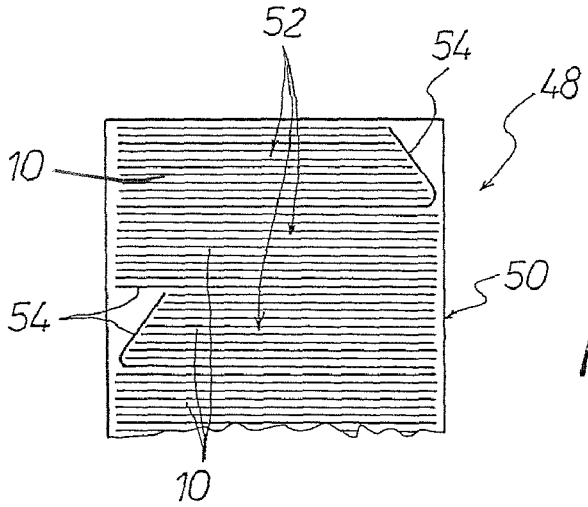
FIG. 7 is a cut-open diagrammatic side view showing a portion of a packing with a plurality of mutually separate, independent layers each with a respective number of thinly compressed lines of elements.

FIG. 7 diagrammatically shows a portion of a configuration of the motion-restraint arrangement 48 which in a packing 50 has a number of mutually independent, separate layers 52 each with a respective number of thinly compressed and thus resiliently stressed lines of elements 10. Each layer 52 has a strip plate 54 in order to guide the lines of elements 10 of the respective layer 52 in a defined direction in space out of the packing 10 after opening thereof.

Figure 8:
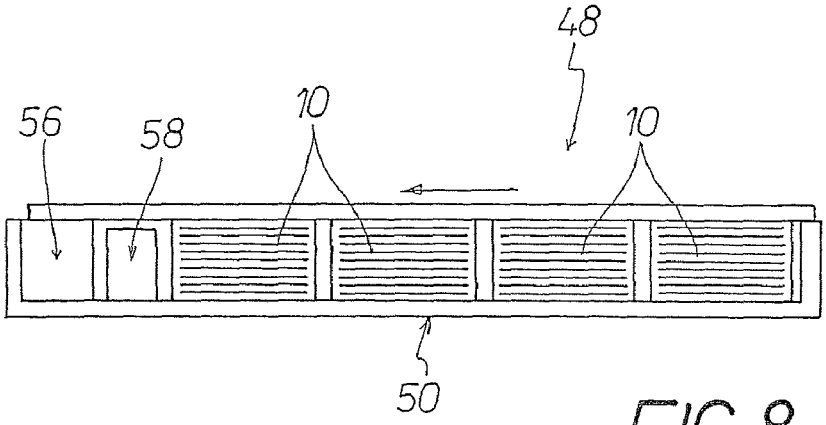
FIG. 8 shows a diagrammatic side view of a configuration of the motion-restraint arrangement with a number of thinly compressed lines of elements in combination with a release device and an effect agent in a packing.

FIG. 8 diagrammatically shows a configuration of the motion-restraint arrangement 48, wherein lines of elements 10 are provided in a thinly compressed condition in a packing 50. The packing 50 has a release device 56. The release device 56 can have a remote control, a sensor arrangement and/or a time delay member. In addition at least one effect agent 58 is provided in or on the packing 50. The effect agent 58 can be for example an electric shock device, a smoke or mist generator, a spray device for an adhesive or an irritant such as CS gas or pepper spray or the like.

LIST OF REFERENCES

10 line of elements (for 48)
12 individual element (of 10)
14 parallelepiped (of 12)
16 flexible longitudinal edge elements (of 10)
18 flexible transverse edge elements (of 10)
20 spatially diagonal zigzag-shaped spring elements (of 10)
22 corners (of 20)
24 spring wires (of 20)
26 eyes (at 22 for 16, 18)
28 securing (of 16, 18 at 22)
30 spatially diagonal spring wires (of 24)
32 connecting elements (for 30 at 22)
34 restraint elements (of 32)
36 outward bulge portion (of 40 at 22 for 38)
38 push-on portion (at 36)
40 surface element (at 22 for 16, 18 and 24)
42 hole (in 40)
44 knob (on 40 at 42)
46 shoulder (of 40)
48 motion-restraint arrangement
50 packing (for 48)
52 layers (in 50 by 10)
54 strip plates (for 52)
56 release device (for 48 from 50)
58 effect agent (on/in 50)

What is claimed is:

1. A motion-restraint arrangement comprising a number of individual elements (12) which are erectable by spring elements (20) from a thinly compressed, small-volume storage condition into a large-volume active condition, each said respective individual element (12) having flexible lateral edge elements (16, 18) comprising flexible transverse edge elements (18) and flexible longitudinal edge elements (16) which in the erected active condition thereof each define a respective parallelepiped (14), the spring elements (20) extend in spatially diagonal relationship between corners (22) of each respective parallelepiped (14), the individual elements (12) jointly forming an elongate line of elements (10), wherein the spatially diagonal spring elements (20) are formed by spring wires (24) which extend in a zigzag shape in a longitudinal direction along the elongate line of elements (10); and wherein each said respective zigzag-shaped spring wire (24) extends integrally with respect to the material thereof along the elongate line of said individual elements (10).

2. A motion-restraint arrangement according to claim 1, wherein each said respective zigzag-shaped spring wire (24) is formed unitarily from one piece of a material.

3. A motion-restraint arrangement according to claim 1, wherein the flexible lateral edge elements (16, 18) are fixed at the corners (22) of the zigzag-shaped spring wires (24).

4. A motion-restraint arrangement according to claim 1, wherein eyelets (26) are provided at the corners (22) of the zigzag-shaped spring wires (24) for fixing the flexible lateral edge elements (16, 18).

5. A motion-restraint arrangement according to claim 1, wherein there is positively secured the fixing of the flexible lateral edge elements (16, 18) at the corners (22) of the zigzag-shaped spring wires (24).

6. A motion-restraint arrangement according to claim 1, wherein said flexible transverse edge elements (18) and said flexible longitudinal edge elements (16) of the individual elements (12) are of equal lengths.

7. A motion-restraint arrangement according to claim 1, wherein said longitudinal edge elements (16) of each second, third or n-th individual element (12) are longer than said transverse edge elements (18) of the individual elements (12).

8. A motion-restraint arrangement according to claim 1, wherein restraint elements (34) are provided at least at some corners (22) of the zigzag-shaped spring wires (24).

9. A motion-restraint arrangement according to claim 1, wherein a number of lines of elements (10) in their thinly compressed small-volume storage condition are provided in a packing (50), which includes a release device (56) for the lines of elements (10).

10. A motion-restraint arrangement according to claim 9, wherein the release device (56) has a time delay member, a remote control and/or a sensor arrangement.

11. A motion-restraint arrangement according to claim 9, wherein the packing (50) includes a number of mutually separate layers (52), each having a respective number of thinly compressed lines of elements (10).

12. A motion-restraint arrangement according to claim 11, wherein each said layer (52) includes a strip plate (54).

13. A motion-restraint arrangement according to claim 9, wherein the packing (50) is combined with at least one effective agent (58).

14. A motion-restraint arrangement according to claim 1, wherein the lines of elements (10) are provided separately independently of each other.

15. A motion-restraint arrangement according to claim 1, wherein at least some of the lines of elements (10) are connected together by flexible connecting elements.

* * * * *